US005309341A

United States Patent [19]

Russello et al.

[11] Patent Number: 5,309,341

[45] Date of Patent: May 3, 1994

[54] LIGHT FIXTURE WITH A REVERSIBLE LENS WITH ADJUSTABLE BRACKETS

[75] Inventors: Thomas Russello, Howell; Richard Sangiamo, Linden, both of N.J.

[73] Assignee: The Genlyte Group Incorporated, Secaucus, N.J.

[21] Appl. No.: 965,209

[22] Filed: Oct. 23, 1992

[51] Int. Cl.[5] ..... F21V 7/00

[52] U.S. Cl. ..... 362/300; 362/333; 362/375

[58] Field of Search ..... 362/300, 368, 362, 145, 362/147, 152, 299, 306, 309, 311, 319, 322, 433, 455, 804, 805, 339

[56] References Cited

U.S. PATENT DOCUMENTS

| | | | |
|---|---|---|---|
| 3,251,987 | 5/1966 | Wince | 362/339 |
| 3,340,393 | 9/1967 | Franck et al. | 362/375 X |
| 3,448,260 | 6/1969 | Wince et al. | 362/333 X |
| 4,462,068 | 7/1984 | Shadwick | 362/375 X |
| 4,587,602 | 5/1986 | Dean et al. | 362/375 |
| 4,590,544 | 5/1986 | Decandia | 362/368 |

*Primary Examiner*—Larry Jones

*Attorney, Agent, or Firm*—Kane, Dalsimer, Sullivan, Kurucz, Levy, Eisele and Richard

[57] ABSTRACT

A light fixture includes a symmetric trough-shaped lens with a first longitudinal side which is substantially clear and a second longitudinal side with prismatic elements. The lens is reversibly mounted with brackets including parallel tines with pairs of opposing protuberances which fit into slots in the fixture. Side reflectors are optionally inserted into the lens inwardly adjacent from the end walls in order to adjust the light distribution pattern.

8 Claims, 10 Drawing Sheets

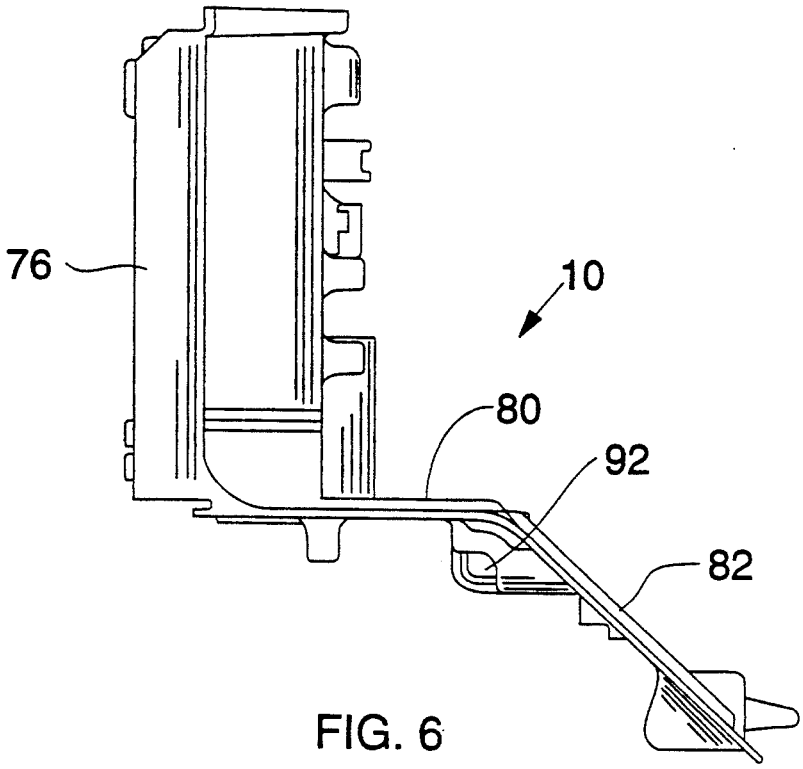
FIG. 6
FIG. 7
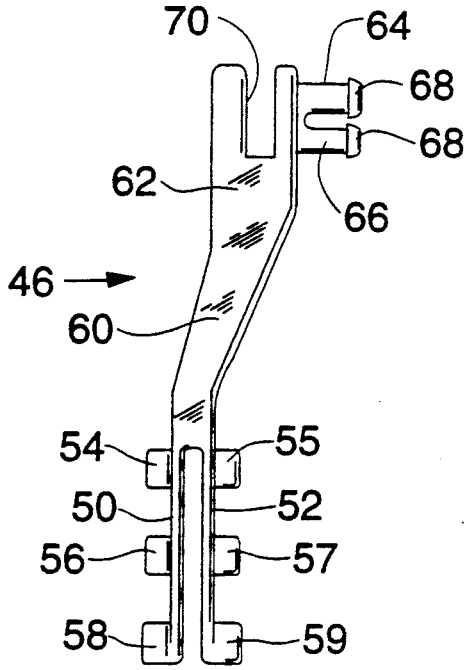
FIG. 8
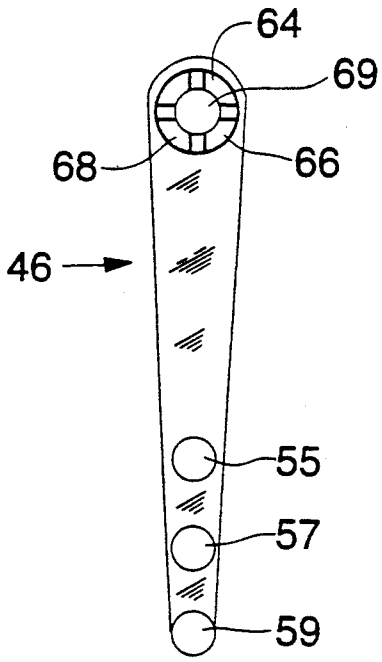

LIGHT FIXTURE WITH A REVERSIBLE LENS WITH ADJUSTABLE BRACKETS

This application is related to application Ser. No. ,07/965,227, filed Oct. 23, 1992, entitled "Light Fixture with Detachable Rear Mounting Box" and U.S. Pat. No. 5,249,110, issued Sep. 28, 1993, filed Oct. 23, 1992, entitled "Light Fixture With Adjustable Bulb and Radiant Heat Dissipating Reflector".

BACKGROUND OF THE INVENTION

1. Field of the Invention

This invention pertains to a light fixture with a reversible lens and adjustable brackets for attaching the light fixture to the mounting box.

2. Description of the Prior Art

In the prior art of outdoor light fixtures, it is well known to use a clear or prismatic lens in front of a lamp, in cooperation with a reflector to project the light into desired areas.

Each lens type can be designed to yield specific light distributions. A light fixture with a prismatic lens refracts light into desired areas with a minimum of glare control factor. A fixture with a clear lens is allowed to reflect light into desired areas, displaying a maximum glare control factor. In some regions, current legislation demands a maximum glare control factor in sensitive environments.

In view of these two applications, it is desirable to provide a lens which can be configured to either application rather than requiring that the lens be changed in order to change the configuration.

Similarly, it is known in the prior art to use reflectors in a light fixture to achieve particular light distribution patterns. However, the changing of reflectors to change the light distribution pattern has been difficult and required substantial alteration of the light fixture.

Moreover, in the prior art, lenses of light fixtures have been susceptible to breakage during installation because the lens could easily be dropped prior to complete installation.

Additionally, in the prior art, lenses of light fixtures have been particularly adapted to a specific light fixture, with very little ability to use a single lens for variations of light fixtures.

OBJECTS AND SUMMARY OF THE INVENTION

It is therefore an object of this invention to provide a lens for a light fixture wherein the lens can be configured in at least two surface textures, such as clear and prismatic.

It is therefore a further object of this invention to provide a lens for a light fixture which is less susceptible to breakage during installation.

It is therefore a still further object of this invention to provide a means for changing reflectors patterns easily in order to change the light distribution pattern.

It is therefore a final object of this invention to provide a lens which is adaptable to a range of light fixture variations.

These and other objects are provided by a light fixture with a symmetric and reversible trough-shaped lens. The symmetry of the lens allows one face of the trough-shaped lens to be of a first texture, such as clear, and the second face to be of a second texture, such as prismatic.

Opposite ends of the trough-shaped lens include brackets journaled upon bolts. The brackets have two parallel tines which may be urged toward each other. The outer faces of the tines include opposed pairs of cylindrical protuberances. In order to install the lens onto the light fixture, the user urges the tines of each bracket together and inserts the brackets into respective slots in the light fixture and releases the tines so that the protuberances engage the edges of the slots. This provides an initial connection between the light fixture and the lens which will ordinarily prevent the lens from falling from the light fixture during the remainder of the installation. In order to complete the installation, the user swings the lens against the light fixture so that the bolts upon which the brackets are journaled align with apertures in the light fixture. The user then rotates the bolts thereby fastening the bolts within the threaded apertures. The plurality of pairs of opposed protuberances on the tines of the bracket allow the user to vary the degree of insertion of the brackets into the slots and thereby allow for variations in distance between the slots and the apertures.

The trough-shaped lens further includes detent means immediately inwardly adjacent from the ends of the trough for the insertion of reflectors therein. Various shaped reflectors can control the degree to which the light is directed forward from the light fixture or peripherally from the light fixture. These reflectors can be easily replaced to vary the pattern of light emanation.

BRIEF DESCRIPTION OF THE DRAWINGS

Further objects and advantages of the invention will become apparent from the following description and claims, and from the accompanying drawings, wherein:

FIG. 6 is a side plan view of the light fixture plate to which the lens is attached.

FIG. 7 is a front plan view of the bracket used to attach the lens to the light fixture.

FIG. 8 is a side plan view of the bracket used to attach the lens to the light fixture.

DETAILED DESCRIPTION OF THE PREFERRED EMBODIMENT

Figure 1:
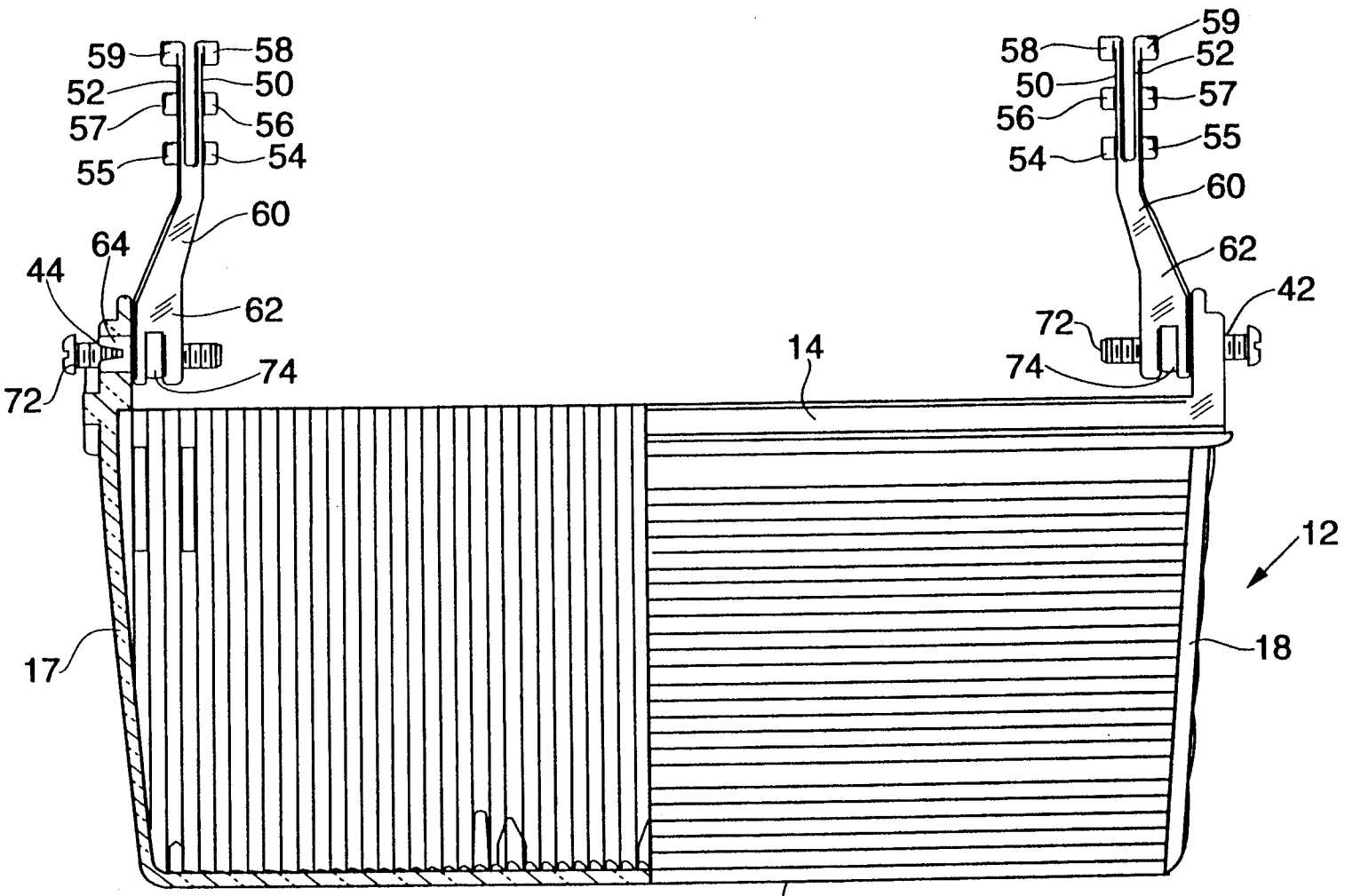
FIG. 1 is a plan view of the lens of the lighting fixture, partly in cross-section, showing the external and internal pattern used on the prismatic face of the lens.
Figure 2:
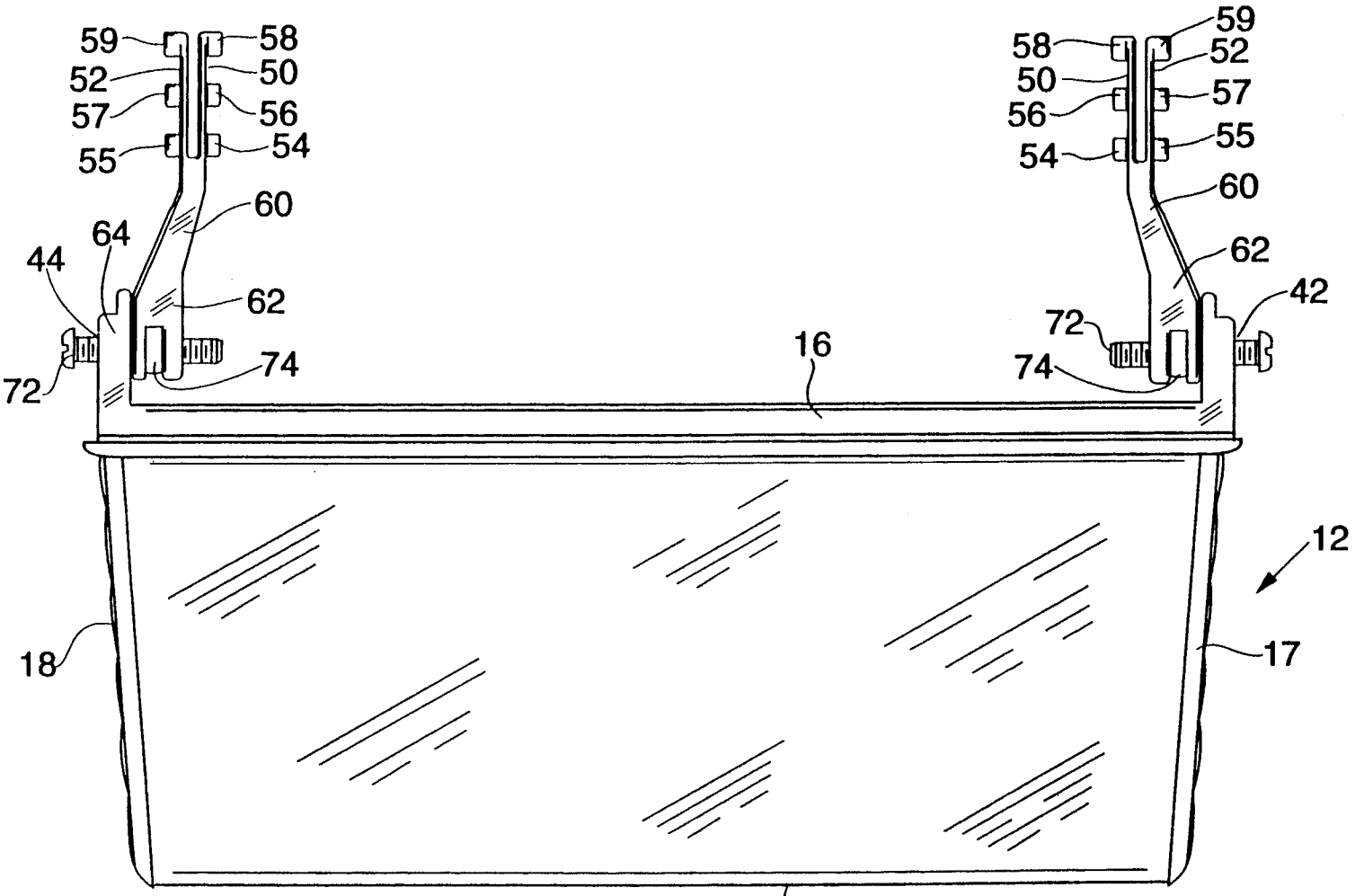
FIG. 2 is a plan view of the lens of the lighting fixture, the reverse view from FIG. 1, showing the clear face of the lens.
Figure 3:
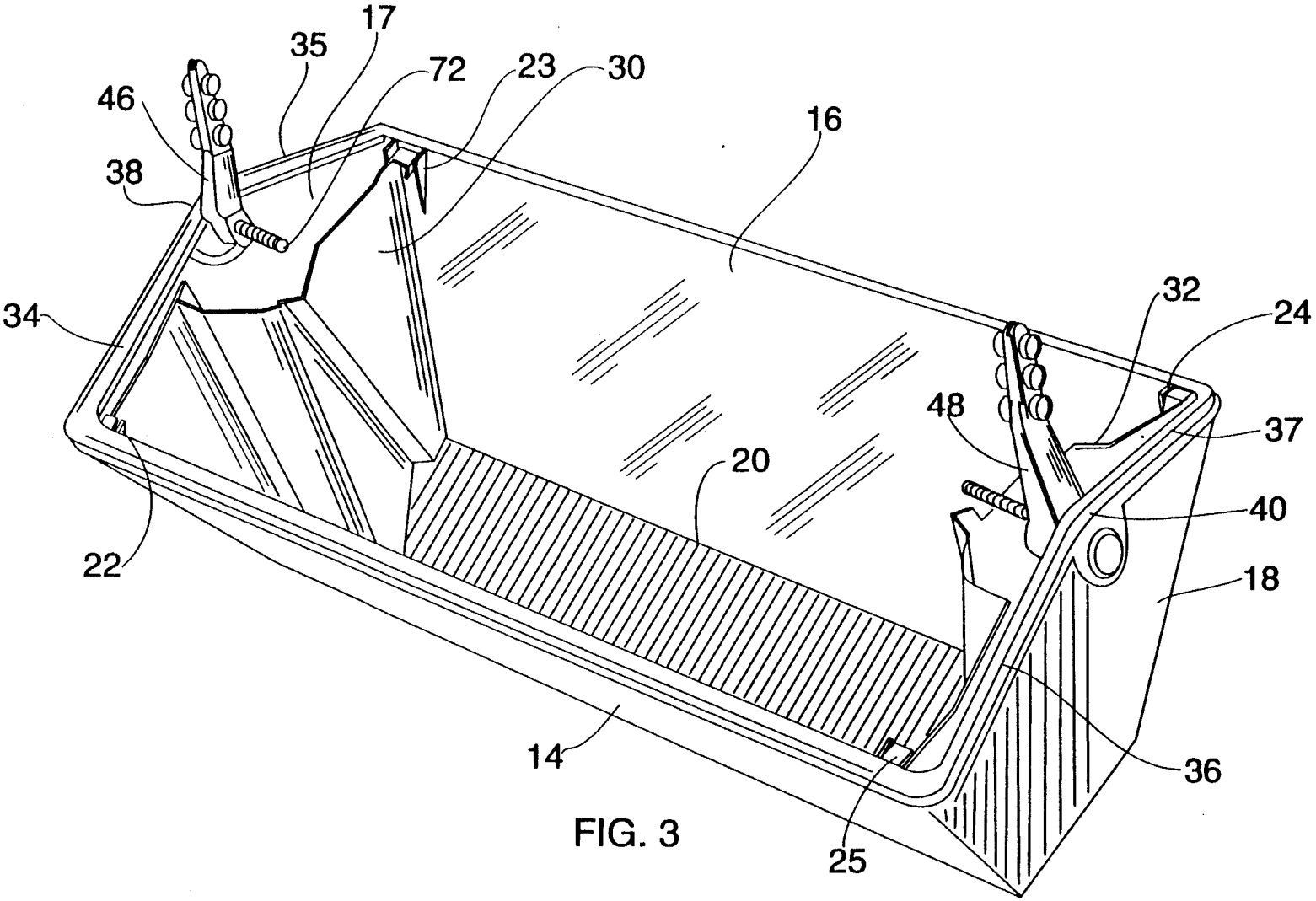
FIG. 3 is an upper perspective view of the lens of the lighting fixture with the side reflectors inserted.
Figure 4:
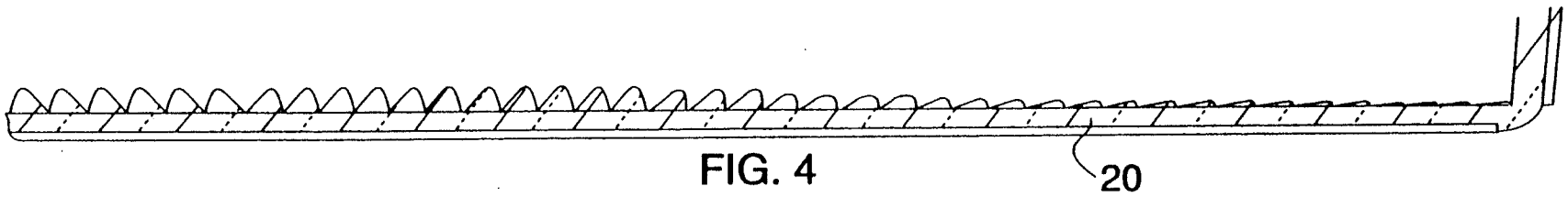
FIG. 4 is a cross-sectional view of the internal pattern used on the prismatic face of the lens.

Referring now to the drawings in detail wherein like numerals refer to like elements throughout the several views, FIG. 1 discloses a lens 12 for a light fixture 10 such as is disclosed in commonly owned application Ser. No. 07/965,227, filed Oct. 23, 1992, entitled "Light Fixture with Detachable Rear Mounting Box" and U.S. Pat. No. 5,249,110, entitled "Light Fixture With Adjustable Bulb and Radiant Heat Dissipating Reflector", the disclosures of which are incorporated herein by reference. As shown in FIGS. 1–3, lens 12 is trough-shaped with a first long side 14 with prismatic elements and a second long side 16 which is clear. The interior of first long side 14 preferably includes horizontal prismatic elements while the exterior of first long side includes vertical prismatic elements with a cross section as illustrated in FIG. 4. Ends 17, 18 include both clear and prismatic portions while bottom 20 is smooth on the exterior and prismatic on the interior as shown in FIG. 4.

Other than the differing texture of various portions of the lens 12, the lens is substantially symmetric about its major longitudinal axis.

Immediately inwardly adjacent of ends 17, 18, on long sides 14, 16, are guide tabs 22, 23, 24, 25. Similarly, immediately inwardly adjacent of ends 17, 18 on bottom 20 are tabs (not shown) to engage, position and align optional reflectors 30, 32. As will be described in greater detail hereinafter, reflectors 30, 32 may be inserted to alter the lighting pattern of light fixture 10.

Ends 17, 18 have upwardly inclined faces 34, 35, 36, 37 rising from the intersections of ends 17, 18 with long sides 14, 16 to reach apexes 38, 40. Apexes 38, 40 include apertures 42, 44 for engaging brackets 46, 48.

As seen in FIGS. 7 and 8, brackets 46, 48 include a pair of parallel tines 50, 52 with pairs of opposing protuberances 54–59. Parallel tines 50, 52 join to form arm 60 which extends downwardly and outwardly from tines 50, 52 to an enlarged portion which forms base 62. Base 62 further includes cylindrical stem 64 formed of prongs 66 at a right angle thereto. Prongs 66 include outwardly extending detent ridge 68 at the end thereof to engage prongs 66 within apertures 42, 44 of lens 12.

Aperture 69 is formed within prongs 66 and extends through base 62 and through slot 70. Bolt 72 extends through aperture 60 and threadedly engages nut 74 which is inserted into slot 70. As will be described hereinafter, protuberances 54–59 are used to make the initial attachment between lens 12 and light fixture 10 while bolts 72 are used to make the final attachment from the lens 12 to the light fixture 10.

Figure 5:
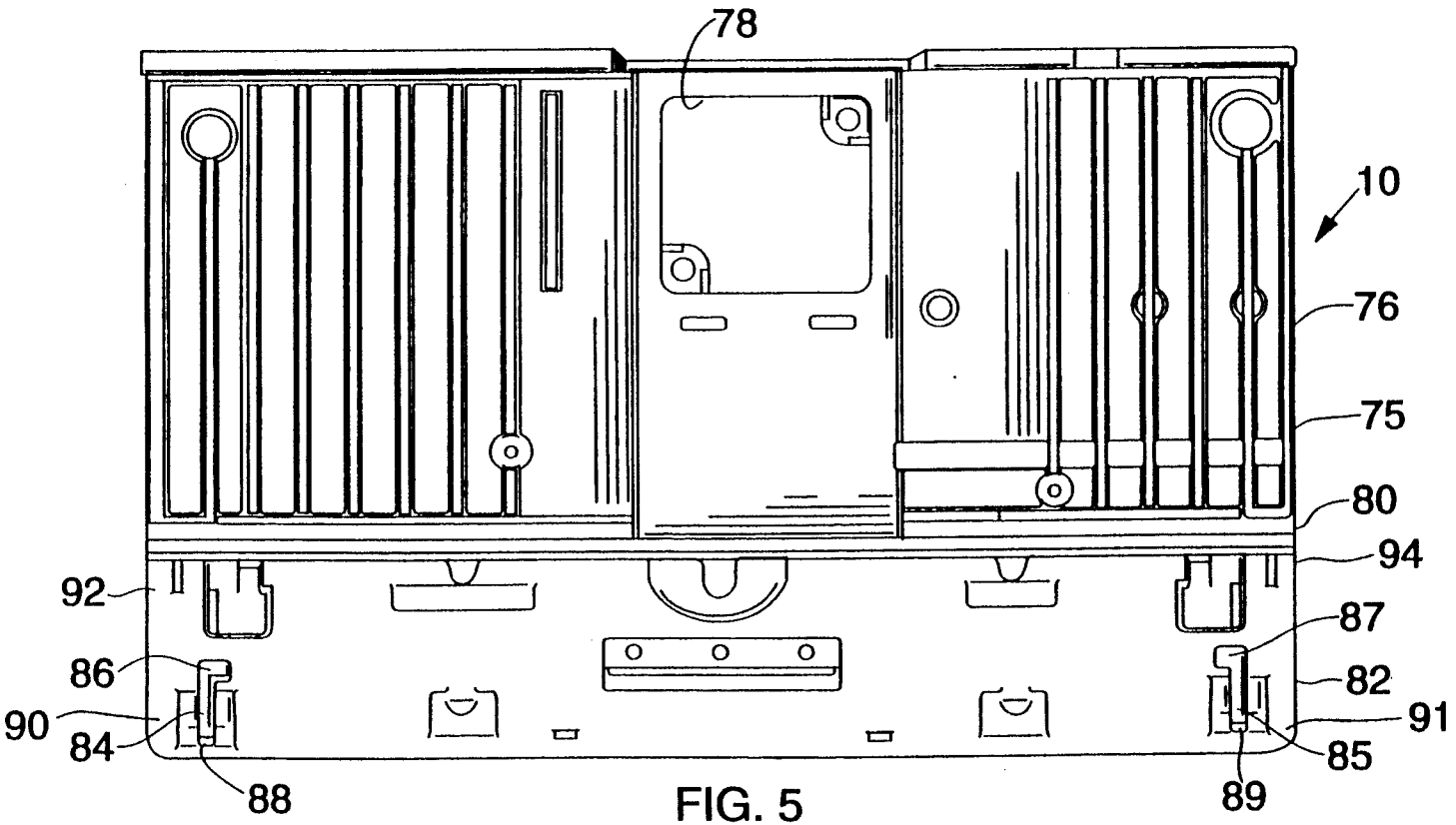
FIG. 5 is a front plan view of the light fixture plate to which the lens is attached.
Figure 11:
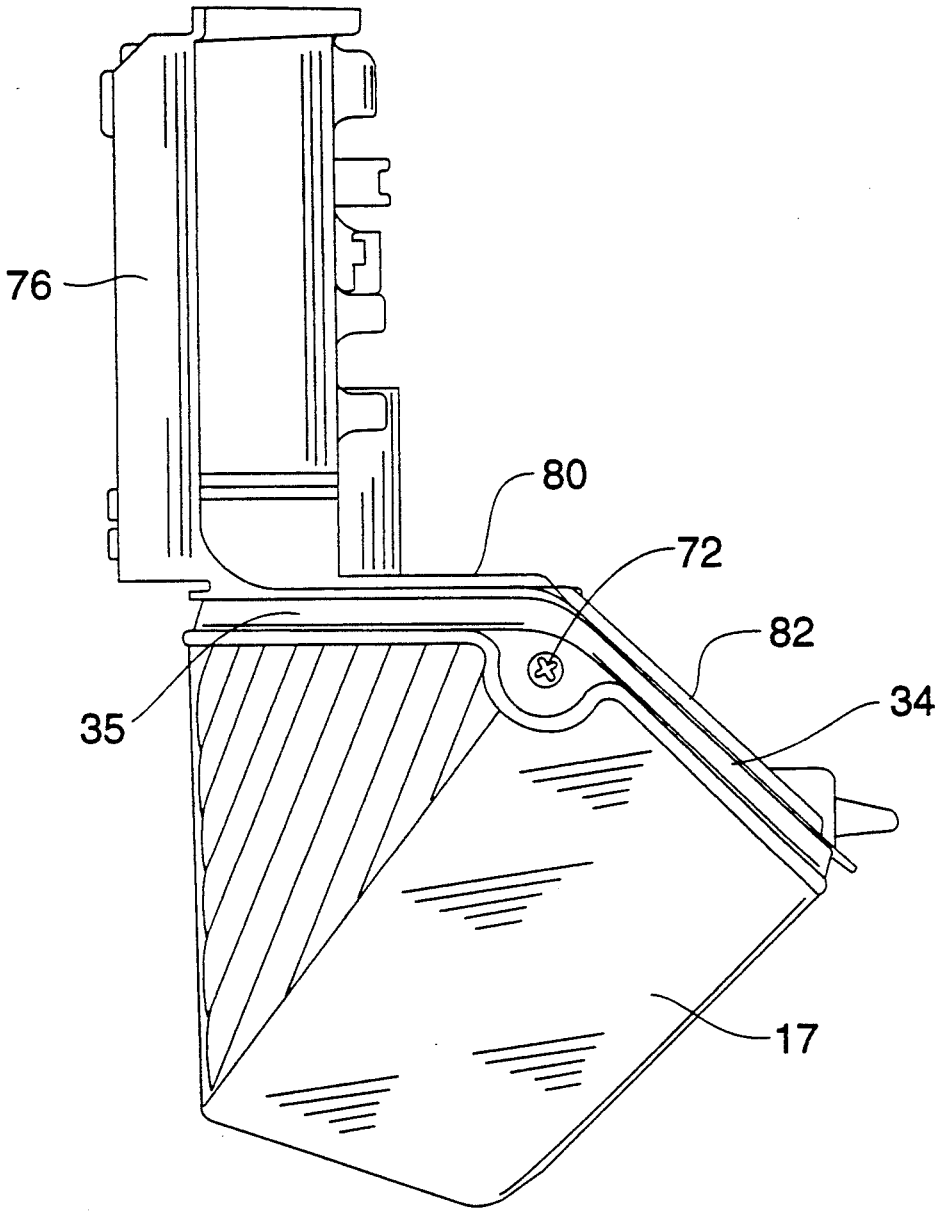
FIG. 11 is a side plan view of the lens fully attached to the light fixture.

As shown in FIGS. 5 and 6, light fixture 10 includes plate 75 which provides the structural support for the various elements thereof (see application Ser. No. 07/965,227, filed Oct. 23, 1992, entitled "Light Fixture with Detachable Rear Mounting Box"). Plate 75 includes a generally vertical portion 76 which is used for support of the capacitor and ballast (not shown, see the application cited above) and an aperture 78 for mounting the vertical portion to a mounting box (not shown) which is secured to the adjacent wall. Plate 75 also includes horizontal portion 80 and inclined portion 82. As shown in FIG. 11, horizontal portion 80 and inclined portion 82 provide the surfaces against which upwardly inclined faces 34, 35, 36, 37 abut when lens 12 is attached to plate 75.

Figure 9:
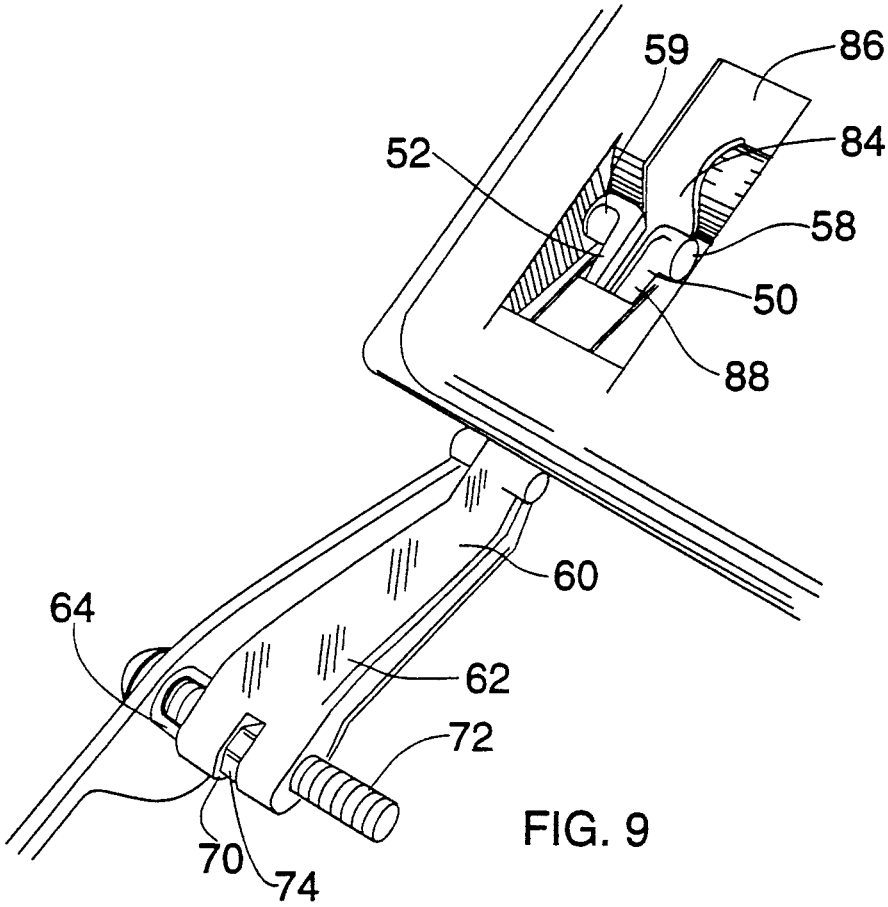
FIG. 9 is a plan view of the initial attachment of the protuberances of the tines of the bracket to the slot in the plate of the light fixture.
Figure 10:
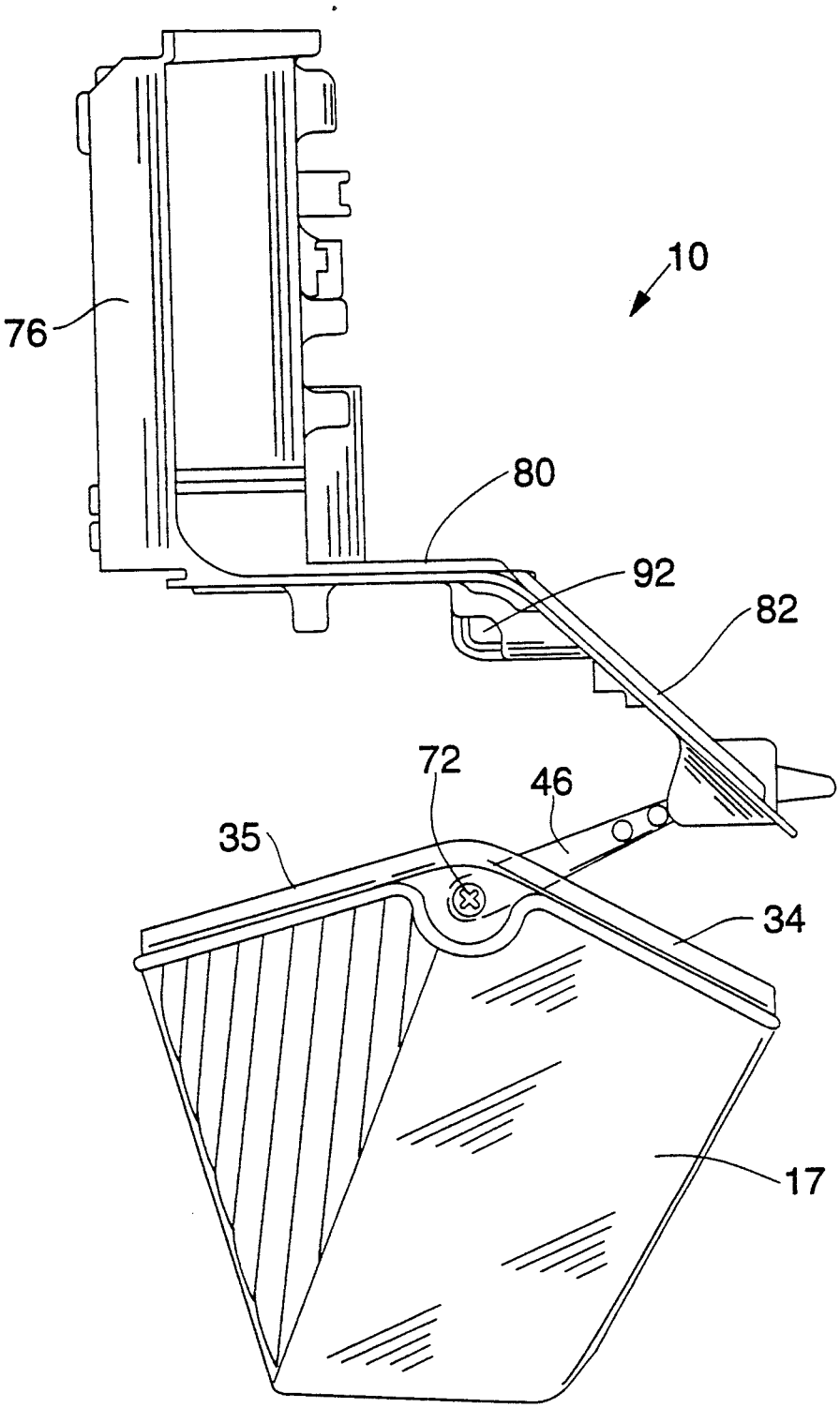
FIG. 10 is a side plan view of the initial attachment of the bracket between the lens at the plate of the light fixture.
Figure 12:
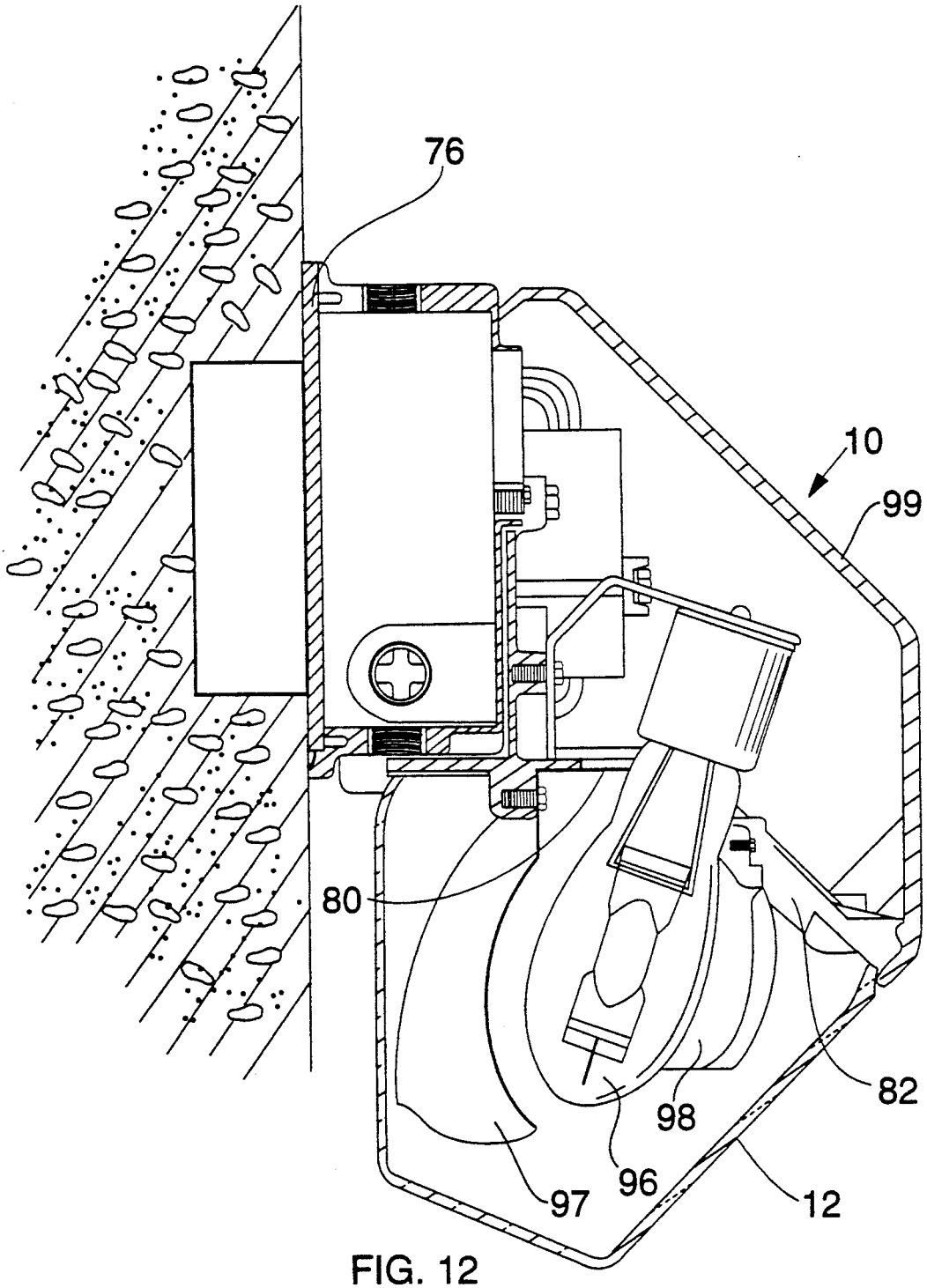
FIG. 12 is a side cross-sectional view, partly in phantom, of the lens fully attached to the light fixture.

Referring to FIGS. 5, 6 and 9, inclined portion 82 includes slots 84, 85 with upper widened portions 86, 87 and lower recessed portions 88, 89 on the lower corners 90, 91 thereof. Additionally, downwardly adjacent from the intersection of horizontal portion 80 and inclined portion 82 are apertures 92, 94. As shown in FIG. 9, in order to perform the initial attachments between the lens 12 and the plate 75, tines 50, 52 of brackets 46, 48 are squeezed together so that a pair of opposing protuberances such as 54, 55 (a different pair of opposing protuberances 54–59 can be chosen so as to adjust for different lengths of brackets 46, 48 or different configurations of plate 75) can be inserted into upper widened portions 86, 87 of slots 84, 85. Brackets 46, 48 are then pulled down into recessed portions 88, 89 of slots 84, 85 so that opposing protuberances 54, 55 engage plate 75 as shown in FIGS. 9 and 10. Lens 12 is then pushed up (note that the optional insertion of reflectors 30, 32 to be described in greater detail hereinafter may be performed prior to this step) so that upwardly inclined faces 34, 35, 36, 37 abut horizontal portion 80 and inclined portion 82 as shown in FIG. 11. Bolts 72 are then inserted into apertures 92, 94 to make the final attachment from lens 12 to plate 75 thereby causing lens 12 to be engaged over bulb 96 and reflectors 97, 98 as shown in FIG. 12. Cover 99, as additionally shown in FIG. 12, is then inserted on the top of the light fixture 10.

Figure 14:
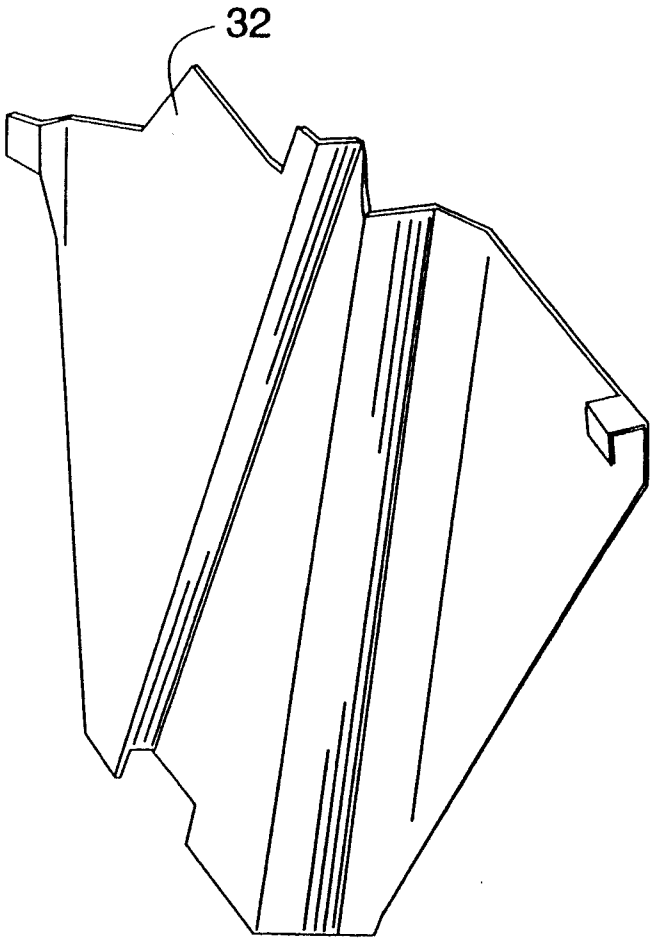
FIGS. 13 and 14 are perspective views of two end reflectors which are optionally inserted into the lens of the light fixture.
Figure 13:
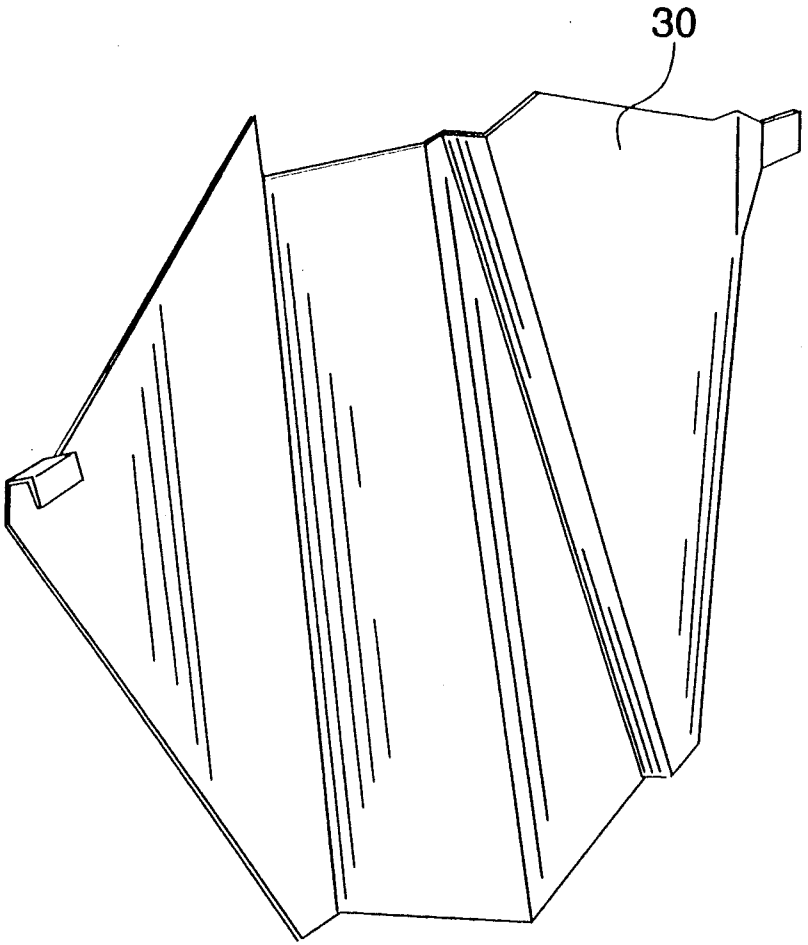

Referring now to FIGS. 3, 13 and 14, reflectors 30, 32 may be optionally inserted into lens 12 between guide tabs 22, 23, 24, 25 either prior to installation of lens 12 or immediately after the initial connections between lens 12 and plate 75 are made.

Reflectors 30, 32 are chosen (or omitted) depending upon the light distribution pattern desired. Reflectors 30, 32 are normally chosen in matched pairs. Reflector 30 as shown in FIG. 13 has a more pronounced deflection than reflector 32 as shown in FIG. 14 and therefore effects a less lateral and more forward light distribution pattern. Likewise, reflector 32 effects a less forward and more lateral light distribution pattern than does reflector 30.

To use light fixture 10, the user optionally installs a pair of reflectors 30, 32 into lens 12 using tabs 22–25. The user orients lens 12 so that the chosen clear or prismatic face of long side 14 or 16 is exposed. The user squeezes tines 50, 52 of brackets 46, 48 together and inserts a pair of opposing protuberances chosen from 54–59 into upper widened portions 86, 87 of slots 84, 85. The user then draws brackets 46, 48 down into recessed portion 88, 89 of slots 84, 85. Lens 12 is placed so that upwardly inclined faces 34, 35, 36, 37 abut horizontal portion 80 and inclined portion 82. Bolts 72 are inserted into apertures 92, 94 to make the attachment from lens 12 to plate 75.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A light fixture of the type including a bulb, a reflector proximate to said bulb and a lens enclosing said bulb and said reflector, the improvement wherein the lens has a first and a second longitudinal wall, a first and a second end wall spanning between ends of said first and said second longitudinal wall, and a bottom engaging said first and said second longitudinal wall and said two end walls thereby forming a symmetric trough shape; wherein said first longitudinal wall has a substantially clear texture and said second longitudinal wall has a prismatic texture; the improvement further comprising means for mounting said lens in a first position exposing said first longitudinal wall or a second position exposing said second longitudinal wall, wherein said second position of said lens is achieved by rotating said lens from said first position.

2. The improvement of claim 1 wherein said second position of said lens is achieved by rotating said lens 180° from said first position.

3. The improvement of claim 1 wherein said lens is rotated between said first and second positions by reversing positions of said first and second end walls against the light fixture.

4. A light fixture of the type including a bulb, a reflector proximate to said bulb and a lens enclosing said bulb and said reflector, the improvement wherein the lens has a first and a second longitudinal wall, a first and a second end wall spanning between ends of said first and said second longitudinal wall, and a bottom engaging said first and said second longitudinal wall and aid two end walls thereby forming a symmetric trough shape; wherein said first longitudinal wall has a substantially clear texture and said second longitudinal wall has a prismatic texture; the improvement further comprising means for mounting said lens in a first position exposing said first longitudinal wall or a second position exposing said second longitudinal wall, wherein said means for mounting includes a first bracket on said first end wall and a second bracket on said second end wall and a first slot and a second slot in the light fixture, wherein said first position is achieved by engaging said first bracket in said first slot and said second bracket in said second slot and said second position is achieved by engaging said first bracket in said second slot and said second bracket in said first slot, wherein said second position of said lens is rotated 180° from said first position.

5. The improvement of claim 3 wherein said first bracket and said second bracket each comprise a pair of parallel tongs with at least one pair of opposing protuberances and wherein said first slot and said second slot include an enlarged portion and a recessed channel.

6. The improvement of claim 5 wherein said brackets engage said slots by said at least one pair of protuberances being inserted through said enlarged portion and drawn into said recessed channel.

7. The improvement of claim 6 wherein said brackets are journaled for rotation about bolts engaging said lens and wherein said bolts engage the light fixture to secure said lens to the light fixture.

8. The improvement of claim 4 further comprising tabs on said first longitudinal wall and said second longitudinal wall immediately inwardly adjacent from said first end wall and said second end wall for engaging side reflectors, wherein an angle of a portion of said side reflectors is pre-selected according to a desired distribution of light from said light fixture.

* * * * *